United States Patent [19]

Johnson, Jr.

[11] 4,235,158

[45] Nov. 25, 1980

[54] METHOD OF MAKING HIGH STRENGTH SHIPPING CARTON

[75] Inventor: A. David Johnson, Jr., Radnor, Pa.

[73] Assignee: Wayne Automation Corporation, King of Prussia, Pa.

[21] Appl. No.: 870,467

[22] Filed: Jan. 18, 1978

[51] Int. Cl.[3] ..... B31B 7/00

[52] U.S. Cl. ..... 493/334; 493/89; 493/90; 493/397

[58] Field of Search ..... 93/37 R, 37 SP, 37 EC, 93/36.01; 53/175

[56] References Cited

U.S. PATENT DOCUMENTS

| | | | |
|---|---|---|---|
| 3,106,876 | 10/1963 | Dewhurst | 93/37 SP |
| 3,134,308 | 5/1964 | Ali-Oglu | 93/37 SP |
| 3,185,047 | 5/1965 | Struble et al. | 93/37 SP |
| 3,621,765 | 11/1971 | Sootheran et al. | 93/37 R |
| 3,715,072 | 2/1973 | Muskopf et al. | 93/37 SP X |
| 3,930,438 | 1/1976 | Hackman et al. | 93/37 R |

*Primary Examiner*—James F. Coan

*Attorney, Agent, or Firm*—Frederick J. Olsson

[57] ABSTRACT

Taking a four panel carton and inserting a divider having end tabs coated with adhesive into the carton and pressing the tabs against the pair of opposite panels to secure the panels and tabs together.

4 Claims, 7 Drawing Figures

METHOD OF MAKING HIGH STRENGTH SHIPPING CARTON

This invention relates to four panel slotted shipping cartons of the kind which invariably are stacked one upon the other during shipment or in storage, and thereby subjecting the lower cartons (and their contents) to damage due to compressive and lateral loads.

More specifically, the invention relates to improvements in the structure of cartons of the kind mentioned and in methods for fabricating the same.

One object of the invention is to provide a high strength carton by integrating a simple, straight forward structural piece with a conventional four panel slotted carton.

Another object of the invention is to provide a standard four panel slotted carton with structural means integral with the carton and functioning to avoid collapse or bulging of the side panels due to compressive loads generated when loaded cartons are stacked one upon the other and due to lateral loads generated by shifting of contents and/or tilting of the stack.

Another object of the invention is to provide a standard four panel slotted carton with structural means integral with the carton and functioning to provide maximum protection of the contents against compressive and lateral loads while employing minimum material and labor.

Another object of the invention is to provide a high strength carton comprising a conventional four panel carton having integral structural means united with the carton after the same is erected for filling at the user's facility.

Another object of the invention is to provide a high strength carton and a method of fabricating the same which uses substantially less material than a comparable strength carton fabricated by conventional techniques.

Another object of the invention is to provide a high strength carton and method of fabricating the same using substantially less labor than a comparable strength carton fabricated by conventional techniques.

Another object of the invention is to provide strengthening means for four panel slotted cartons which is especially useful for increasing the strength of cartons of the type having a pair of relatively long sides.

Another object of the invention is to eliminate the need for cartons having high compressive and lateral strength to be of special configuration and the consequent necessity of fabricating on custom equipment.

The invention will be explained below in connection with the following drawings wherein.

With respect to the description below, it will be understood that the term "carton" is used herein as conventionally understood in the art and includes cardboard shipping cartons wherein the cardboard material is comprised of a pair of flat liners joined by a corrugated medium. The term "slotted" is inclusive of regular slotted and half-slotted cartons, blind slotted cartons and of such cartons where all flaps meet or where only part of the flaps meet.

Figure 4:
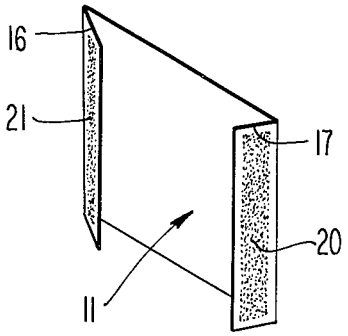
FIG. 4 is a perspective view showing the tabs folded back over the divider as positioned for inserting in a four panel slotted carton.
Figure 5:
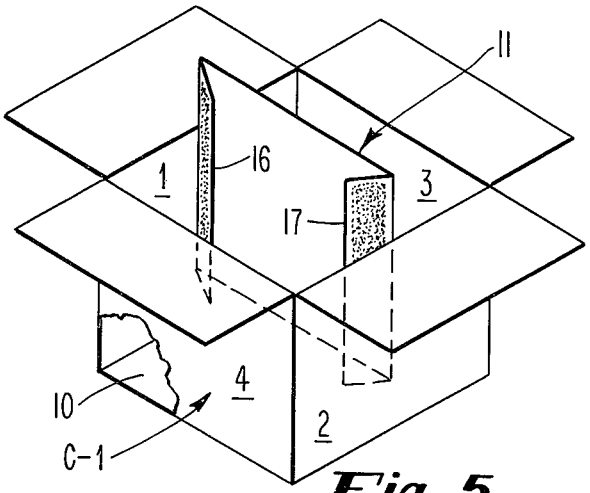
FIG. 5 is a perspective view of the divider of FIG. 4 being inserted in a four panel slotted carton.

A typical four panel regular slotted carton is indicated in FIGS. 4 and 5 at C-1. The carton has four side panels 1, 2, 3 and 4. Connected to the side panels are the top flaps 5, 6, 7 and 8 which, when closed over, form the top of the carton. Similar flaps are connected to the bottom of the panels and are closed over to form the bottom 10.

Figure 6:
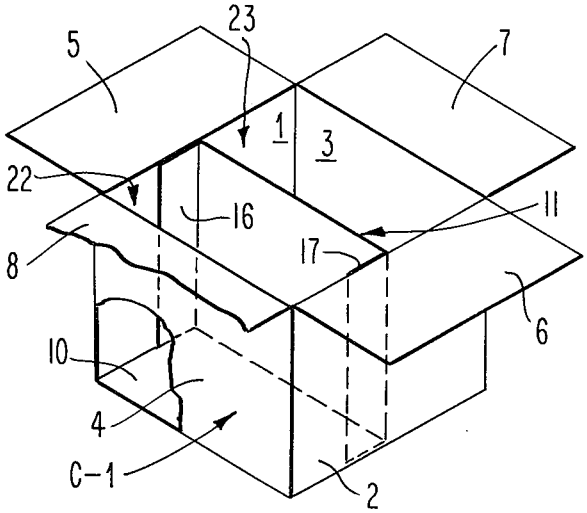
FIG. 6 is a perspective view of the assembly of FIG. 5 with the divider fully inserted and the adhesive joining the tabs and panels.

While the carton of FIGS. 5 and 6 is shown with panels of substantially equal length, it will be understood that four panels slotted cartons include those which have two long sides and two short sides.

Figure 1:
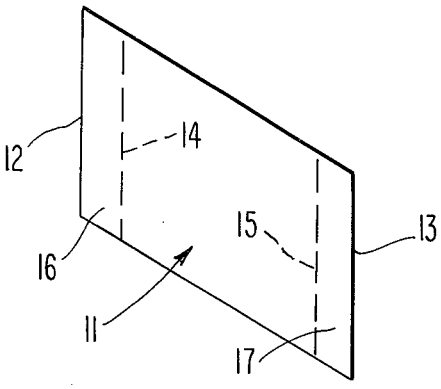
FIG. 1 is a perspective view of a cardboard sheet to be fabricated into a divider for a four panel carton.

Referring to FIG. 1, a generally rectangular shaped divider is indicated at 11. The divider 11 will be inserted into the carton C-1 and adhesively united with panels 1 and 2 and function as a structural member as will be commented on later.

The divider may be formed from the same cardboard material as the cartons or may be formed from other material depending upon the size or contents of the carton or the application for which the carton is designed. The divider is flat and rectangular in shape and has continuous straight edges. With this design, waste in fabrication is negligible and this contributes to cost reduction.

Adjacent the opposite edges 12 and 13 of the divider are formed parallel score lines 14 and 15. Material in the areas between the respective edges and score lines constitutes the tabs 16 and 17. The score lines are preferably provided during the process of cutting the divider.

The dimensions of the divider are indicated by the size of the carton with which it will be used. In the instant case, the height of the divider is made substantially the same as the inside height of the panels 1–4. The score lines are spaced apart a distance substantially the same as the inside distance between opposite panels 1 and 2.

Figure 2:
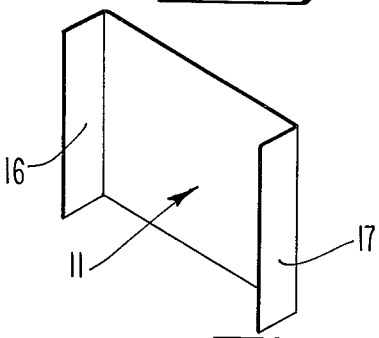
FIG. 2 is a perspective view of the divider of FIG. 1 illustrating tabs formed on opposite edges.

The divider with the tabs is subjected to an operation which folds the tabs inwardly and normal to the plane of the divider, as indicated in FIG. 2.

Figure 3:
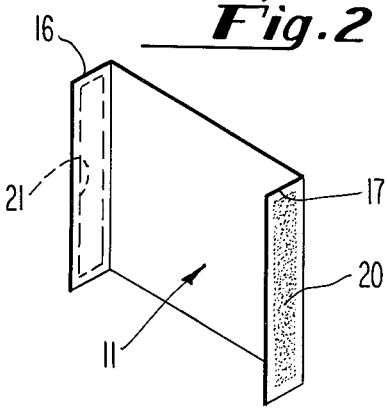
FIG. 3 is a perspective view showing adhesive applied to the outer surfaces of the tabs of the divider of FIG. 1.

In the next operation, adhesive is applied to the outer surfaces of the tabs, for example, the adhesive as indicated at 20 and 21 in FIG. 3.

For inserting the divider in the carton, the tabs 16 and 17 are further folded inwardly so that each makes an acute angle with the divider as noted in FIG. 4. The angular position is maintained during the insertion process as is indicated in FIG. 5.

When the divider is firm against the bottom 10, the tabs are pressed against the respective panels 1 and 2. This allows the adhesive to form a bond between tab and panel and firmly hold the same together. The divider forms compartments 22 and 23.

While the operations of FIGS. 2–4 are shown as discrete individual steps it will be understood that tab folding and adhesive applying may be performed in different sequences, for example, the tab may be folded back to the angled condition of FIG. 4 and retained therein and the adhesive applied to the tabs while the divider is being inserted into the carton.

Before closing, comments follow with respect to certain alternatives and with respect to the increase in structural strength of the cartons achieved by the invention.

Figure 7:
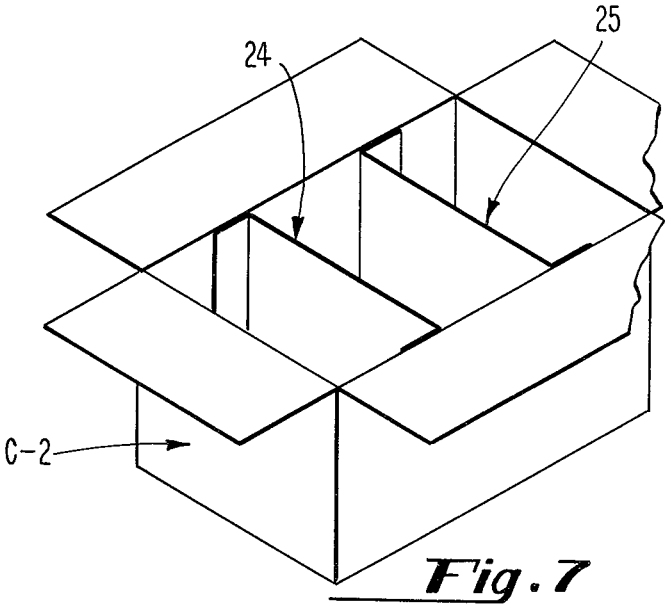
FIG. 7 is a perspective view of a four panel slotted carton having a pair of dividers.

While the above method has been described in connection with a single divider, it will be readily apparent that a pair of dividers may be employed. This construction is especially useful for cartons having a pair of long sides where the need for support is greater. A typical long-sided carton C-2 having dividers 24 and 25 is illustrated in FIG. 7.

It will be understood that the structural advantages noted above may be obtained where the adhesive is applied on the panels rather than on the tabs.

Another manner of inserting the divider involves placing the divider with unfolded tabs into the carton so that the same extends generally diagonally corner-to-corner and then rotating the divider to cause the tabs to sweep along the respective panel surfaces and bend into position. In this case, the adhesive may preferably be applied to the panels and the tabs bend in opposite directions.

When the divider is united with a pair of opposite side panels, it becomes a structural member which increases both the compressive and the lateral strength of the carton.

For example, the compressive strength of carton C-1 is increased not only because the divider 11 is a centrally located member or columm but most importantly because the column effect is enhanced by that both the divider 11 and panels 1 and 2 are fixedly tied together.

The lateral strength of both the tied-in and non-tied panels is bettered. For example, with respect to the tied panels, the force developed by contents shifting against say panel 1 is resisted not only by panel 1 but also by panel 2 (due to the tie-in by the divider 11). It will be readily apparent, that the foregoing feature is very desirable for long wall cartons of the kind shown in FIG. 7.

With respect to the non-tied panels, the ability to resist is enhanced because the divider reduces the amount of lateral force acting centrally of the panel. For example, if the direction of thrust is against the panel 3, only the contents of compartment 23 would react directly on panel. The contents in compartment 22 would be restrained by the divider.

I claim:

1. The method of increasing the compressive and lateral strength of a four panel carton by:

providing an open, fully erected and complete four panel carton;

inserting an independent divider inside of said carton to extend between two opposite panels and at the same time applying adhesive means on tab areas respectively on opposite edges of the divider; and pressing each said tab area against its panel so that the adhesive means can form a bond between the tab area and panel and secure the panels and tab areas together.

2. The method of increasing the compressive and lateral strength of a four panel carton comprising the steps:

providing an open, fully erected and complete four panel carton;

providing a divider with tabs on two opposite edges thereof;

inserting the divider into the carton and at the same time applying adhesive means on the outside surface of each tab; and causing the divider to extend between two opposite panels and for the adhesive means on each tab to respectively engage said opposite panels whereby to secure the tabs and panels together.

3. The method of increasing the compressive and lateral strength of a four panel carton comprising the steps:

providing an open, fully erected and complete four panel carton;

providing a divider with tabs on two opposite edges thereof;

inserting the divider into the carton and at the same time applying adhesive on each said tab;

causing the divider to extend between two opposite panels with the tabs positioned for the adhesive thereof to engage the opposite panels; and pressing each tab and its panel together so that the adhesive can form a bond between the tab and panel to secure the same.

4. The method of providing a strengthening divider inside of a four panel carton comprising the steps of:

providing an open, fully erected and complete four panel carton;

providing a generally flat, rectangular shaped divider;

making a pair of score lines respectively parallel two opposite edges of the divider, the material between each said opposite edges and the score line adjacent thereto constituting an end tab;

at each score line, folding the tab back on the plane of the divider so that the tab forms an acute angle with the plane of the divider;

while maintaining each tab in said angular condition, inserting the divider into the carton so that the same extends between two opposite panels and at the same time applying adhesive on the outer surface of each tab; and pressing each tab against its panel so that the adhesive can form a bond between panel and tab and secure same together.

* * * * *

Disclaimer 4,235,158.—*A. David Johnson, Jr.*, Radnor, Pa. METHOD OF MAKING HIGH STRENGTH SHIPPING CARTON. Patent dated Nov. 25, 1980. Disclaimer filed Aug. 27, 1981, by the aissignee, *Wayne Automation Corp.*

Hereby enters this disclaimer to claims 1, 2, 3 and 4 of said patent.

[*Official Gazette October 20, 1981.*]